US006712358B1

(12) United States Patent
Dimitriou et al.

(10) Patent No.: US 6,712,358 B1
(45) Date of Patent: Mar. 30, 2004

(54) PUZZLE DEVICE

(75) Inventors: Spiro Nickolaos Dimitriou, Punchbowl (AU); Akrum Afif Geha, Sydney (AU)

(73) Assignee: Leisure Learn Pty Ltd, Sydney (AU)

( * ) Notice: Subject to any disclaimer, the term of this patent is extended or adjusted under 35 U.S.C. 154(b) by 0 days.

(21) Appl. No.: 10/312,384

(22) PCT Filed: Jul. 11, 2000

(86) PCT No.: PCT/AU00/00841

§ 371 (c)(1),
(2), (4) Date: Mar. 3, 2003

(87) PCT Pub. No.: WO01/03787

PCT Pub. Date: Jan. 18, 2001

(30) Foreign Application Priority Data

Jul. 12, 1999 (AU) ..... PQ 1573

(51) Int. Cl.[7] ..... A63F 9/08
(52) U.S. Cl. ..... 273/157 R; 273/156
(58) Field of Search ..... 273/157 R, 156, 273/153 R, 153 S; 446/92

(56) References Cited

U.S. PATENT DOCUMENTS 2,570,625 A * 10/1951 Zimmerman et al. ..... 446/92
3,407,530 A * 10/1968 Grant et al. ..... 446/92
4,238,905 A * 12/1980 MacGraw, II ..... 446/92
5,127,652 A * 7/1992 Unger ..... 273/157 R
5,520,396 A * 5/1996 Therrien ..... 273/156
6,439,571 B1 * 8/2002 Wilson ..... 273/157 R

* cited by examiner

*Primary Examiner*—Steven Wong
(74) *Attorney, Agent, or Firm*—D. Peter Hochberg; Sean Mellino; Katherine R. Vieyra

(57) ABSTRACT

A puzzle device includes a plurality of separate blocks that are assembled together as a unit which can be manipulated between different configurations. At least one magnet is arranged along an edge of at least certain of the blocks to attract the edge of another block in juxtaposition with it. The two juxtaposed blocks are able to be manipulated to rotate about an axis formed along the two juxtaposed edges, a stronger attractive force being exerted at the axis between the two juxtaposed blocks, and a weaker attractive force is exerted along the juxtaposed edges parallel to but remote from the axis. This enables faces of the blocks in contact to be split apart and rotated about the axis until another pair of faces come into contact, such that, in this new position, a stronger attractive force is again exerted at the axis and a weaker attractive force is again exerted remote from the axis, the stronger attractive forces holding the separate blocks together as a unit in all the configurations of the unit. The unit is arranged so that it can be manipulated between one configuration and another only when two of the axes are brought into alignment, in which case the aligned axes create a "fold line" along which manipulation can occur.

5 Claims, 5 Drawing Sheets

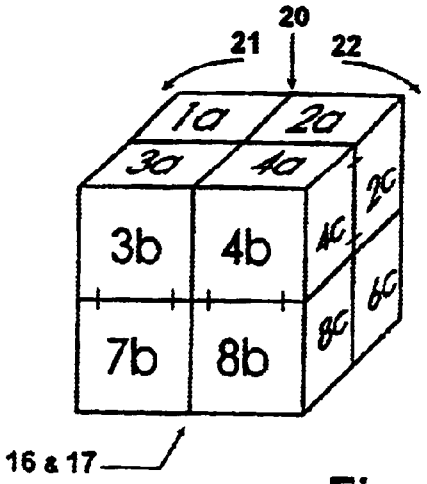
Fig. 2
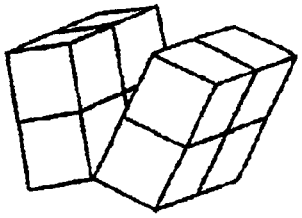
Fig. 2.1
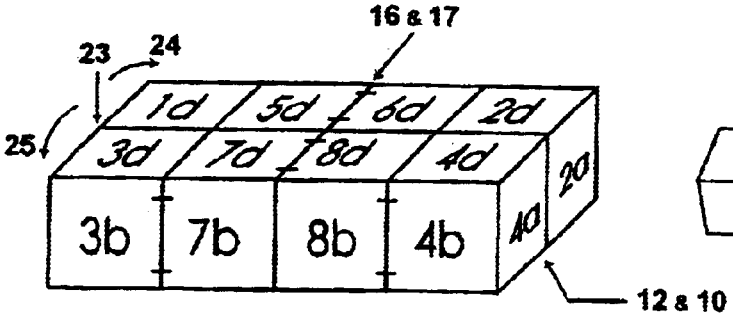
Fig. 3
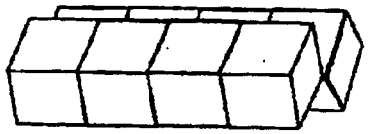
Fig. 3.1
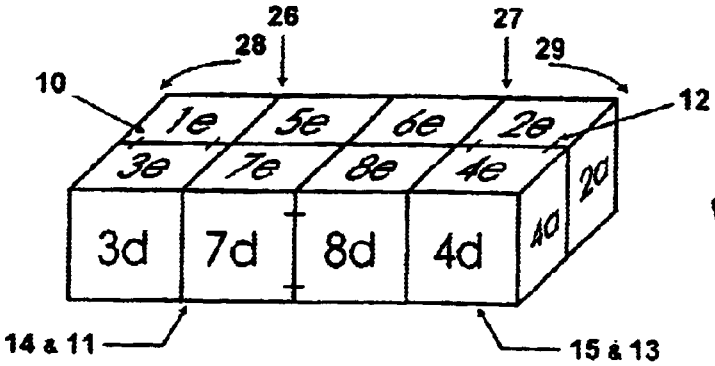
Fig. 4
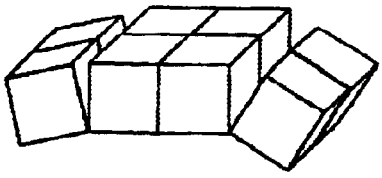
Fig. 4.1

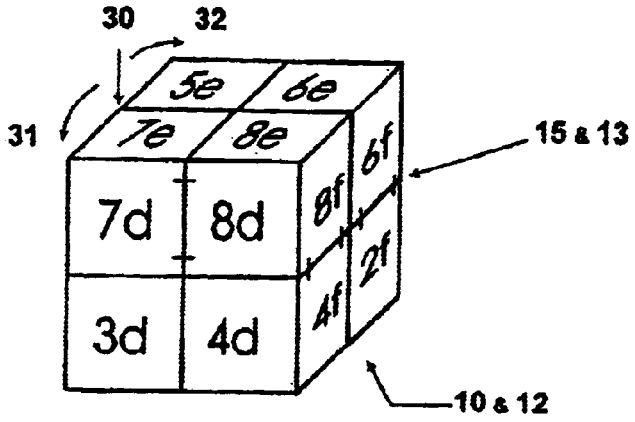
Fig. 5
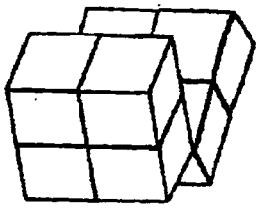
Fig. 5.1
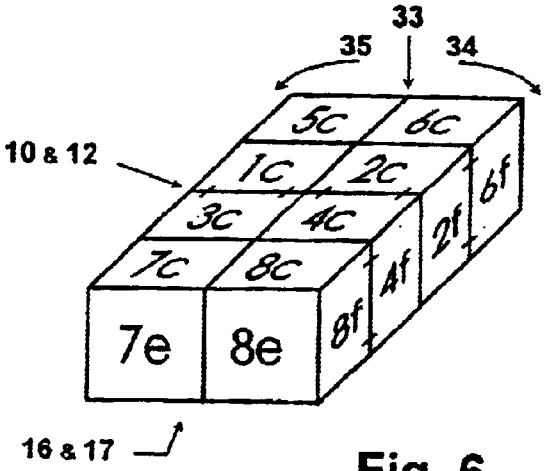
Fig. 6
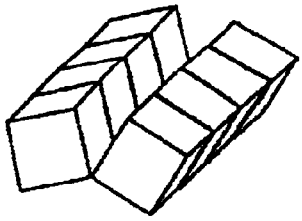
Fig. 6.1
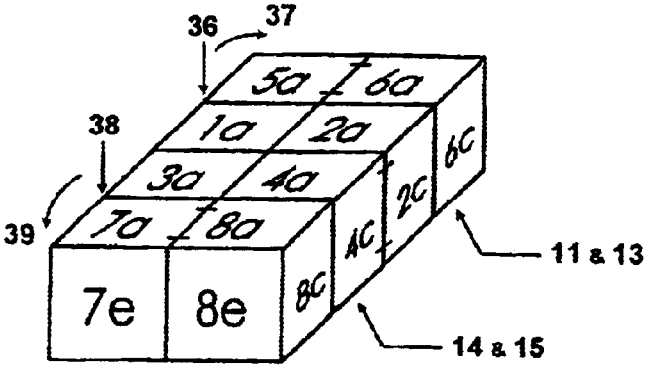
Fig. 7
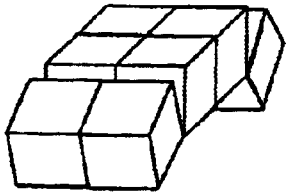
Fig. 7.1

PUZZLE DEVICE

CROSS REFERENCE TO RELATED APPLICATION

This application is the National Stage of International Application No. PCT/AU00/00841 filed Jul. 11, 2000.

TECHNICAL FIELD

The invention relates to a puzzle device of the type comprising a plurality of blocks that are assembled together as a unit which can be manipulated into a variety of configurations. In particular, but not exclusively, the invention concerns a puzzle device of the type comprising a large cube made up of eight smaller cubes. In a further aspect, the invention concerns such puzzle devices where indicia are arranged on the surfaces of the blocks in a manner which allows arithmetic or logic problems to be solved by manipulation of the puzzle.

BACKGROUND ART

There have been several well known manipulation puzzles. In some, the various pieces have to be assembled, and a counter intuitive approach is required in order to succeed. In another type, a pattern must be matched on the surface of the device by continued manipulation.

In yet another type of puzzle, the device must be manipulated to reconfigure it. One such device is known where eight small cubes are interconnected by flexible hinges. In this device each of the small cubes is connected to two other cubes by flexible straps along two of its edges, the connected edges of each cube being on different faces so that the cube can be manipulated as follows:

Starting with the cubes arranged in a large cube, the large cube can be manipulated by splitting it in half vertically to lay each half out to either side, so forming a first flat configuration. This flat configuration can either be folded back up into the large cube, or split in half to rotate the back four smaller cubes backwards and the front four forwards, so forming a second flat configuration. The second flat configuration can either be folded back to the first, or the pair of cubes at either end can be rotated downwards and then inwards to form a second large cube. The second large cube can be manipulated back to the second flat configuration, or split vertically from front to back to form a third flat configuration. The third flat configuration can then be split like the first flat configuration to produce a fourth flat configuration. The fourth flat configuration can be manipulated like the second to reproduce the original cube.

SUMMARY OF THE INVENTION

According to a first aspect of the invention, there is provided a puzzle device which includes a plurality of separate blocks that are assembled together as a unit which can be manipulated between different configurations; and at least one magnet arranged along an edge of at least certain of the blocks to attract the edge of another block in juxtaposition with it, so that the two juxtaposed blocks are able to be manipulated to rotate about an axis formed along the two juxtaposed edges, a stronger attractive force being exerted at the axis between the two juxtaposed blocks, and a weaker attractive force is exerted along the juxtaposed edges parallel to but remote from the axis, to enable faces of the blocks in contact to be split apart and rotated about the axis until another pair of faces come into contact, such that, in this new position, a stronger attractive force is again exerted at the axis and a weaker attractive force is again exerted remote from the axis, the stronger attractive forces holding the separate blocks together as a unit in all the configurations of the unit, where the unit is arranged so that it can be manipulated between one configuration and another only when two of the axes are brought into alignment, in which case the aligned axes create a "fold line" along which manipulation can occur.

Manipulation of the puzzle device requires the blocks to be gently pulled in order to find the fold lines. Strong resistance to movement will be encountered when the blocks are pulled in other directions because of the forces holding the blocks together, but when the blocks are pulled in the direction required to open along a fold line it will open readily because of the weak force holding it closed. Further, the blocks will positively close across a fold line due to the weak attraction between the faces. This variety of forces as the device is manipulated has been found to have good play value.

In the most successful forms of the device there will be at least two fold lines present in every configuration, so that play can be endless in either forward or reverse directions.

Preferably, each block has four bar magnets arranged therein. One pair of magnets may be arranged in spaced end-to-end relationship along an edge of one face and a further pair of magnets may be arranged in spaced end-to-end relationship along and edge of another face with the pairs being arranged orthogonally with respect to each other. Further, the arrangement may be such that one of the magnets of one of the pairs has an outer end in the face having the other pair of magnets.

It may be possible to construct a device embodying the invention using many different types of magnets, provided they fit within the blocks. However it is preferred to use small bar magnets positioned in the corners of the blocks with one exposed face of each magnet having a pole. Instead, a bar magnet may be positioned within the block with a pole in the centre of a face of the block. In either case, one pole is exposed and the opposite pole is within the block. When the north pole is exposed, the south pole is contained within the block (and vice versa) to reduce the effect of repulsive forces causing the blocks to fall apart. The arrangement of the magnets can be calculated but is generally determined through a process of trial and error using the attraction/repulsion principles of magnets. In a complicated puzzle it can take some time to determine positions for the magnets which will allow the puzzle to operate correctly.

In a simple example the device is made up of eight small cubes which can be manipulated between two larger cubic configurations and four flat 2×4 configurations. In this embodiment small bar magnets are arranged within the small cubes as described with reference to FIGS. 8 and 9.

In another aspect of the invention, there is provided a puzzle device of the type comprising a plurality of blocks that are assembled together as a unit which can be manipulated between different configurations; in a starting configuration, several operands are displayed accompanied by respective first indicia, such as colours and an operator; in a second configuration, several operands are also displayed together with second indicia, such as designs; on remaining faces of the blocks, further operands are displayed together with first and second indicia, such that, to solve a given operation between any one operand from a starting configuration and another operand from a second configuration, the puzzle is manipulated into different configurations until a face is found on which an operand is located together with appropriate first and second indicia, the operand displayed on said face providing the solution.

In one example, the puzzle is made up of eight small cubes which can be manipulated between two larger cubic configurations and four flat 2×4 configurations. The first indicia may be colours, the second indicia may be designs and the operands may be numbers. The operator and operands may be displayed in a starting configuration, such as on a compound face of a large cubic configuration.

The faces of the small cubes may be decorated as shown in Table 1, and the puzzle may be arranged to solve additions of the numbers shown on faces 1*a*, 2*a*, 3*a* and 4*a*.

BRIEF DESCRIPTION OF THE DRAWINGS

Examples of the invention will now be described with reference to the accompanying drawings, in which:

FIG. 2 is an embodiment of the device of FIG. 1, in a first cubic configuration, and showing where a first manipulation occurs;

FIG. 2.1 is the device of FIG. 2, during the first manipulation;

FIG. 3 is the device of FIG. 2 after the first manipulation, in a first flat configuration, and indicating where a second manipulation takes place;

FIG. 3.1 is the device of FIG. 3, during the second manipulation;

FIG. 4 is the device in a second flat configuration after the second manipulation has taken place, and indicating where a third manipulation takes place;

FIG. 4.1 is the device of FIG. 4, during the third manipulation;

FIG. 5 is the device in a second cubic configuration after the third manipulation has taken place, and indicating where a fourth manipulation takes place;

FIG. 5.1 is the device of FIG. 5, during the fourth manipulation;

FIG. 6 is the device in a third flat configuration after the fourth manipulation has taken place, and indicating where a fifth manipulation takes place;

FIG. 6.1 is the device of FIG. 6, during the fifth manipulation;

FIG. 7 is the device in a fourth flat configuration after the fifth manipulation has taken place, and indicating where a sixth manipulation takes place to return the device to the first cubic configuration;

FIG. 7.1 is the device of FIG. 7, during the sixth manipulation;

BEST MODE OF INVENTION

Figure 1:
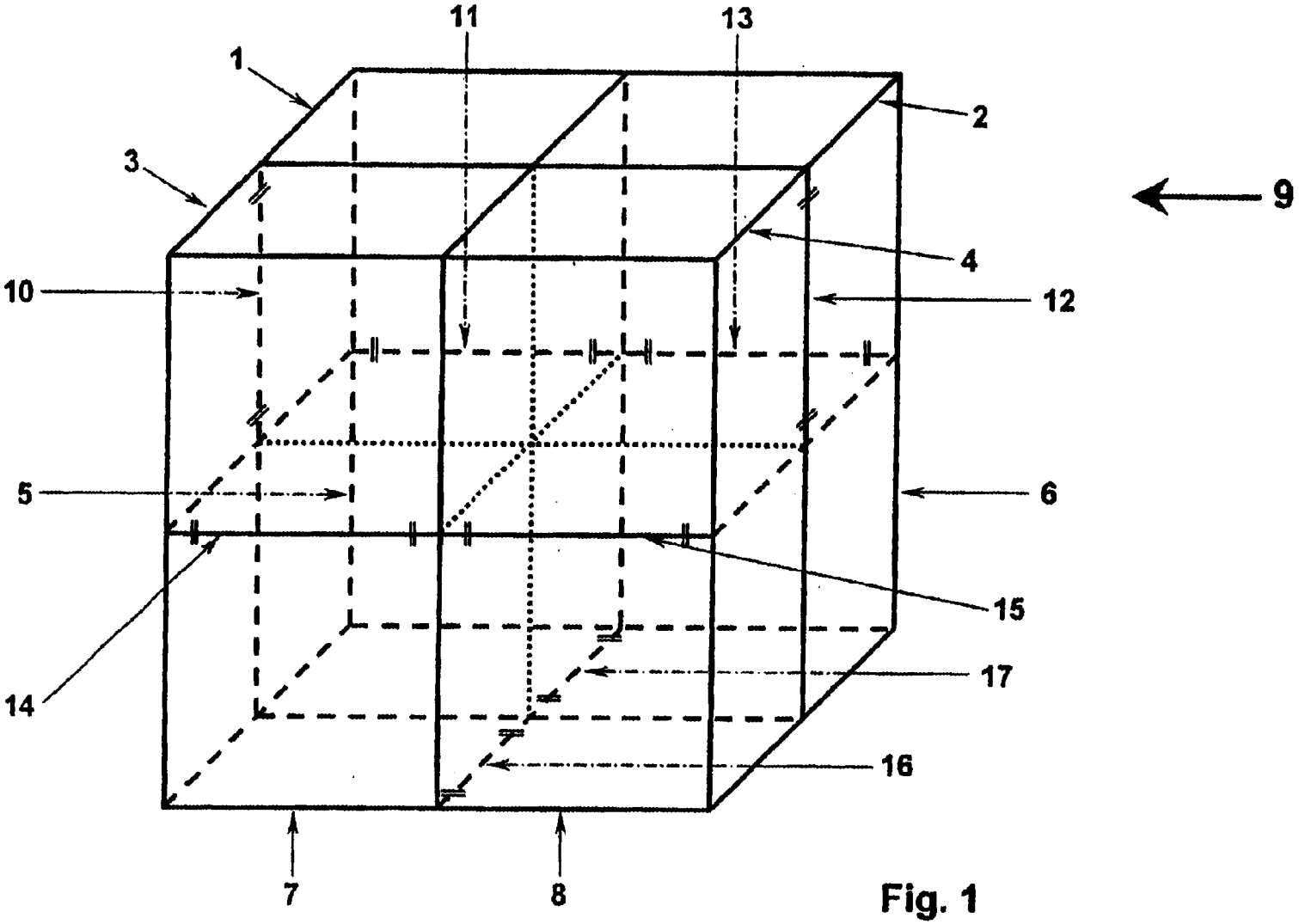
FIG. 1 is a perspective view of a puzzle device embodying the invention showing internal joins.

Referring first to FIG. 1, the configuration of a puzzle device, in accordance with the invention, will be described in an initial cubic configuration. The device comprises eight small blocks or cubes 1, 2, 3, 4, 5, 6, 7 and 8 arranged to form a larger cube 9. Each small cube contains magnets (not shown in FIG. 1), but which co-operate with the magnets of adjacent cubes to create axes about which adjacent cubes can rotate with respect to each other. There are eight axes 10, 11, 12, 13, 14, 15, 16 and 17.

Each cube has six sides, and for convenience these have been labelled 'a', 'b', 'c', 'd', 'e' and 'f'. Looking at FIG. 2 cubes 1, 2, 3 and 4 have face 'a' uppermost whereas cubes 5, 6, 7 and 8 have face 'a' downmost. Cubes 3, 4, 7 and 8 have face 'b' to the front, whereas cubes 1, 2, 5 and 6 have face 'b' to the back. Cubes 1, 3, 5 and 7 have face 'c' to the left whereas cubes 2, 4, 6 and 8 have face 'c' to the right. FIG. 2 shows all the visible faces of FIG. 1 labelled accordingly.

Returning to FIG. 1, axis 10 extends between cubes 1 and 3 where face 1*c* meets face 3*c*. Axis 11 extends between cubes 1 and 5 where face 1*b* meets face 5*b*. Axis 12 extends between cubes 2 and 4 where face 2*c* meets face 4*c*. Axis 13 extends between cubes 2 and 6 where face 2*b* meets face 6*b*. Axis 14 extends between cubes 3 and 7 where face 3*b* meets face 7*b*. Axis 15 extends between cubes 4 and 8 where face 4*b* meets face 8*b*. Axis 16 extends between cubes 7 and 8 where face 7*a* meets face 8*a*. Axis 17 extends between cubes 5 and 6 where face 5*a* meets face 6*a*. During manipulation of the puzzle device the small cubes remain in contact along the axes described.

In the configuration shown in FIG. 1 of the drawings, axes 11 and 13 are colinear, axes 14 and 15 are colinear and axes 16 and 17 are colinear to define fold lines about which predetermined groups of cubes can be rotated as will be described in greater detail below.

A first manipulation splits large cube 9 down the centre indicated in FIG. 2 at number 20, and rotates cubes 1, 3, 5 and 7 to the left away from cubes 2, 4, 6 and 8 which move to the right about a fold line defined by colinear axes 16 and 17, as indicated by arrows 21 and 22 respectively.

The arrangement of magnets within the cubes functions so that a weak magnetic force holds the cube together along the vertical split except along the fold line created by axes 16 and 17.

As described above, wherever two axes are colinear or aligned a fold line is created. So starting from the cube showing in FIG. 1 it is also possible to manipulate the puzzle about the fold line created by axes 14 and 15 or the fold line created by axes 11 and 13.

The arrangement of the magnets in the small cubes ensures only a weak magnetic force holds the cube together along the fold lines. In fact magnetic attraction arising from magnets at the axes which make fold lines are sufficient to keep the cube in any of its configurations. However, the magnets are also arranged so that much stronger magnetic forces resist folding along any other lines.

After the first manipulation has taken place the device is in its first flat configuration in which face 'd' is visible on the upper surface. Faces 3*b*, 7*b*, 8*b* and 4*b* are visible along the front and faces 4*a* and 2*a* along the right hand side, as can be seen in FIG. 3. In this configuration the device can fold back along the fold line created by axes 16 and 17, but it can also fold along the fold line created by the colinearity of axes 10 and 12 although the axes are spaced from each other by the central group of cubes 5, 6, 7 and 8. That is by splitting along the centre indicated at 23, and rotating cubes 1, 5, 6 and 2 backwards in the direction indicated by arrow 24 and cubes 3, 7, 8 and 4 forwards in the direction indicated by arrow 25. This rotation continues until the under surface is folded up and the forward and rear surfaces become the new under surface, as shown in FIG. 4 where the device is in its second flat configuration.

From the second flat configuration of FIG. 4 as well as being folded back into the first flat configuration, the device is able to fold along the fold lines created by the colinearity of axes 11 and 14 and the colinearity of axes 13 and 15. In other words both the left and right ends of the device can be folded downward, by splitting at 26 and 27, and rotating the left hand end down and under in the direction indicated by arrow 28, and the right hand end down and under in the direction of arrow 29. The effect of this manipulation is to create a second cubic configuration, as shown in FIG. 5.

The second large cube shown in FIG. 5 has faces 5*e*, 6*e*, 7*e* and 8*e* on the top, faces 7*d*, 8*d*, 3*d* and 4*d* at the front, and face 8*f*, 6*f*, 4*f* and 2*f* on the right hand side. As well as returning to the second flat configuration the second cube is able to be split vertically from front to back along the centre indicated at number 30. In this manipulation the cubes 3, 4, 7 and 8 move forward in the direction indicated by arrow 31, and cubes 1, 2, 5 and 6 move backwards in the direction indicated by arrow 32, revolving around the fold line caused by the colinearity of axes 10 and 12 under the cube.

Following this manipulation the cube enters its third flat configuration as shown in FIG. 6 where face 'c' of each cube is uppermost. In the third flat configuration the device can be manipulated in the same way as the first flat configuration, by coalignment of axes 16 and 17 to split the device along the centre indicated at 33 with the cubes 6, 2, 4 and 8 moving to the right in the direction indicated by arrow 34, and cubes 5, 1, 3 and 7 moving to the left in the direction indicated by arrow 35. After this manipulation the device enters a fourth flat configuration as shown in FIG. 7.

In the fourth flat configuration the device can be manipulated in the same manner as the second flat configuration, that is by colinearity of axes 11 and 13 at the back and colinearity of axes 14 and 15 at the front to form two fold lines. The rear most two cubes 5 and 6 can be split away from the remainder along the split indicated at 36 and rotated backwards and down in the direction indicated by arrow 37, whereas at the same time the front two cubes 7 and 8 can be split as indicated at 38 and folded forward and down in the direction indicated by arrow 39, to recreate the first cubic configuration of FIG. 2.

The cube may be manipulated at will forwards and backwards through this sequence of configurations.

The arrangement and shape of magnets within the cubes must not only operate to create the fold lines to ensure the device folds well, but must also be arranged so as not to create unwanted fold lines or to create unwanted attractive forces which might prevent opening along fold lines. In addition the magnets must operate to give rise to weak forces holding the puzzle closed along the fold lines. In general the magnets must be arranged along a fold line so that they will attract the respective faces of adjacent cubes in both conditions of the fold. This will be described in greater detail now with reference to FIG. 8 which is an exploded representation of FIG. 4, looking down from above onto face 'e'.

Figure 8:
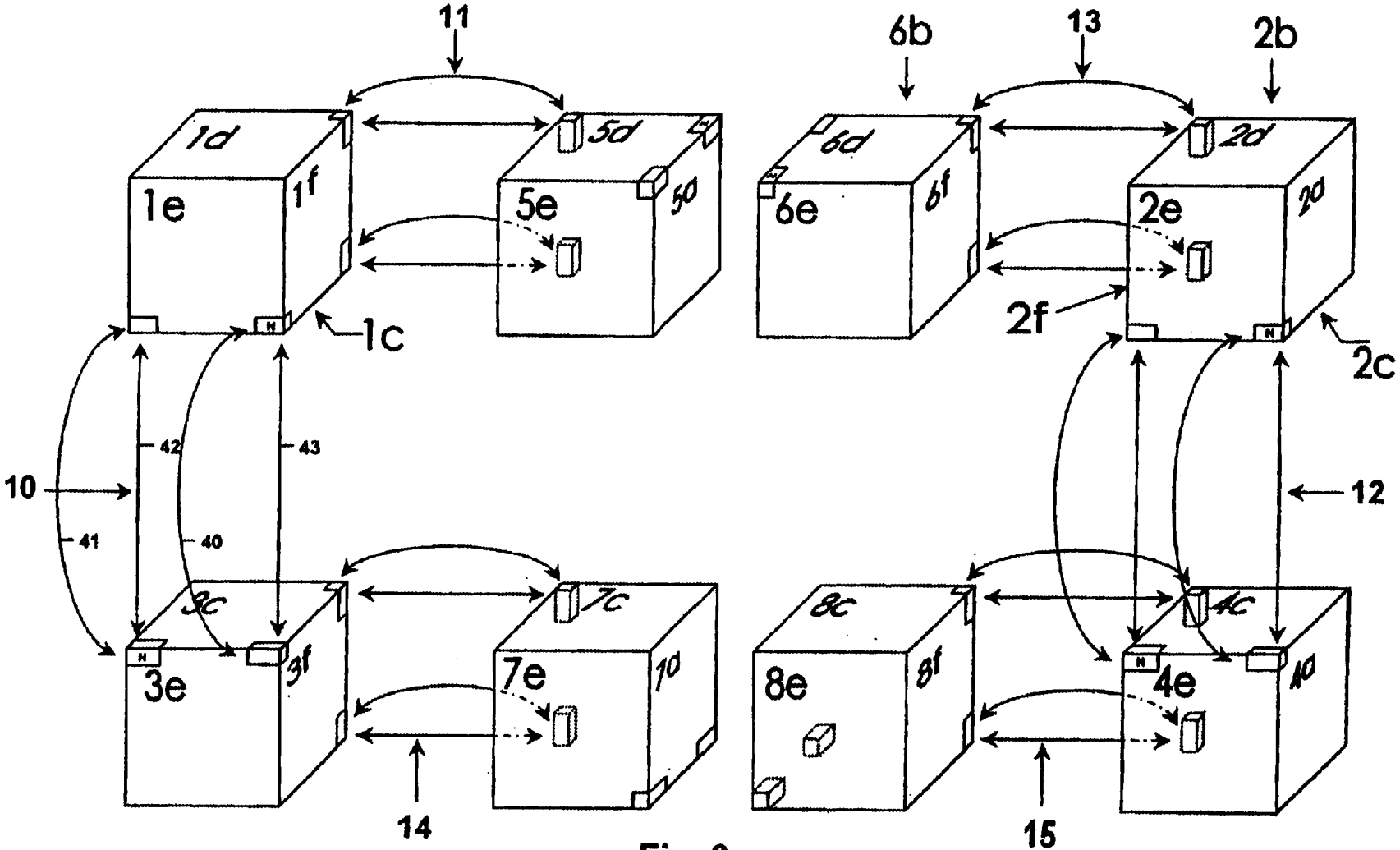
FIG. 8 is an exploded, top view of the second flat configuration.

In FIG. 8 all the small cubes are 3.5 cm long, high and wide. Each also contains four small bar magnets which are rectangular or oblong in shape but much smaller than the cube, being 10 mm×5 mm×4 mm. The locations of all the magnets are shown as rectangles marked in the corners, or interior where the magnet is in the hidden vertex, but they have not all been numbered for the sake of clarity. Some of the north poles however are shown by the letter 'N'. The direction of the axes 10, 11, 12 and 14 are also marked in FIG. 8.

Taking axes 10 and 12 first. These two axes co-operate to form the fold line by which the device can be manipulated between the second and first flat configurations.

Axis 10 is created by four magnets, two in cube 1 along the same edge of face 1*e*, and two in cube 3 along face 3*e*. These magnets produce weak attractive forces between faces 1*e* and 3*e* to hold the device closed in the first flat configuration, and also between faces 1*c* and 3*c* to hold the device closed in the second flat configuration as shown by arrows 42 and 43. Axis 12 operates in a similar manner but is not described in detail. The other magnets are oriented so as not to produce attraction or repulsion between faces 5*c* and 7*c* or 6*c* and 8*c*, 5*e* and 7*e* or 6*e* and 8*e*. However, the other axes are arranged to create attractive forces to hold the cubes together in this configuration.

Fold line 13 operates in a similar manner with two magnets in cube 6 and two in cube 2. These magnets are arranged at the corners of cubes 2 and 6 along axis 13 and are arranged to cause weak attraction between faces 2*f* and 6*f* and 2*b* and 6*b*. Axes 11, 14 and 15 operate similarly.

Figure 9:
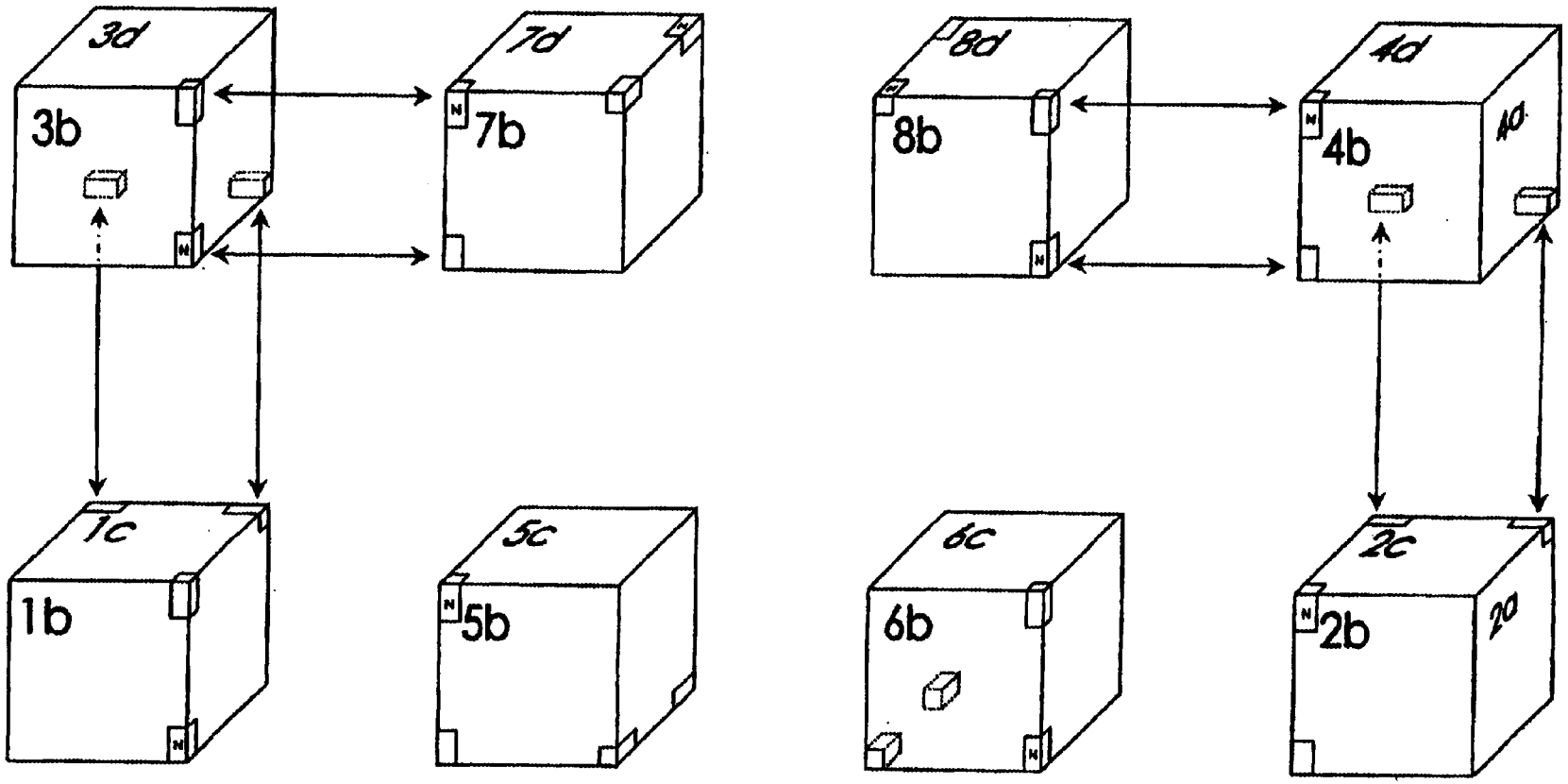
FIG. 9 is an exploded, bottom view of the second flat configuration.

FIG. 9 shows the reverse view and the remaining north poles. It will be appreciated that the magnets may be arranged in other configurations in order to achieve the same results.

In a further embodiment the device may be used to solve simple arithmetic or logic problems by decorating the faces of the small cubes with appropriate indicia. For instance the cube faces may be decorated as follows to create an adding cube:

TABLE 1

| | |
|---|---|
| 1a | bears the numeral 2, the colour yellow and part of the addition sign |
| 1b | bears the numeral 13 and a blue crab |
| 1c | bears the numeral 10 and a red bear |
| 1d | bears the numeral 1 and a white seal |
| 1e | bears the numeral 3 and a yellow seal |
| 1f | bears the numeral 8 and a green elephant |
| 2a | bears the numeral 4, the colour red and part of the addition sign |
| 2b | bears the numeral 16 and a blue dog |
| 2c | bears the numeral 6 and a red elephant |
| 2d | bears the numeral 4 and a white mouse |
| 2e | bears the numeral 6 and a yellow mouse |
| 2f | bears the numeral 12 and a green bear |
| 3a | bears the numeral 6, the colour green and part of the addition sign |
| 3b | bears the numeral 9 and a blue seal |
| 3c | bears the numeral 11 and a red cat |
| 3d | bears the numeral 5 and a white crab |
| 3e | bears the numeral 7 and a yellow crab |
| 3f | bears the numeral 9 and a green tiger |
| 4a | bears the numeral 8 the colour blue and the final part of the addition sign |
| 4b | bears the numeral 12 and a blue mouse |
| 4c | bears the numeral 7 and a red tiger |
| 4d | bears the numeral 8 and a white dog |
| 4e | bears the numeral 10 and a yellow dog |
| 4f | bears the numeral 13 and a green cat |
| 5a | bears part of an ornamental picture |
| 5b | bears the numeral 14 and a blue bear |
| 5c | bears the numeral 9 and a red crab |
| 5d | bears the numeral 2 and a white elephant |
| 5e | bears the numeral 4 and a yellow elephant |
| 5f | bears the numeral 7 and a green seal |
| 6a | bears another part of the ornamental picture |
| 6b | bears the numeral 15 and a blue cat |
| 6c | bears the numeral 5 and a red seal |
| 6d | bears the numeral 3 and a white tiger |
| 6e | bears the numeral 5 and a yellow tiger |
| 6f | bears the numeral 11 and a green crab |
| 7a | bears another part of the ornamental picture |
| 7b | bears the numeral 10 and a blue elephant |
| 7c | bears the numeral 12 and a red dog |
| 7d | bears the numeral 6 and a white bear |
| 7e | bears the numeral 8 and a yellow bear |
| 7f | bears the numeral 10 and a green mouse |
| 8a | bears the remaining part of the ornamental picture |
| 8b | bears the numeral 11 and a blue tiger |

TABLE 1-continued

| | |
|---|---|
| 8c | bears the numeral 8 and a red mouse |
| 8d | bears the numeral 7 and a white cat |
| 8e | bears the numeral 9 and a yellow cat |
| 8f | bears the numeral 14 and a green dog |

When cubes 1, 2, 3 and 4 are kept together in the first cubic configuration the parts of the addition sign combine to make a complete addition sign. The cube operates as follows to solve simple addition sums:

Starting with the cube in the first cubic configuration with 1*a*, 2*a*, 3*a* and 4*a* displayed on the top of the cube, the numbers 2, 4, 6 and 8 can be read together with the addition sign. The cube can be used to add one of the numbers displayed on the top of the cube to a white animal displayed on the first flat configuration.

Take for instance the blue 8 in the first cubic configuration. Then open the cube to the first flat configuration and take the number 6 on face 7*d* together with a white bear. The cube is manipulated until a bear is found in the colour of the first operand, that is, the blue colour of the number 8. The blue bear is found on the underside of the second flat configuration in face 5*b* and together with this blue bear is the number 14, which is the answer to the sum of 8 and 6.

For another example, to add 8 and 2, begin at blue 8 on the first cubic configuration. Manipulating the cube to the first flat configuration reveals a white elephant together with the number 2 on face 5*d*. Searching for a blue elephant ends on face 7*b* on the reverse side of the second flat configuration, where the answer 10 is also displayed. This answer could have been arrived at alternatively by starting with yellow 2 on the first cubic configuration and then manipulating the cube to the first flat configuration to reveal a white dog together with the number 8 on face 4*d*. Searching for a yellow dog ends on face 4*e* on the second flat configuration, where the answer 10 is also displayed.

Similar arrangements could be made to provide the answers to other arithmetic functions, mathematical or logical problems and linguistic puzzles.

It of course should be appreciated that the mathematical and logical computational ability does not depend upon the magnetic operation of the device, and the hinges could be created by flexible joints in this case.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

What is claimed is:

1. A puzzle device which includes a plurality of separate blocks that are assembled together as a unit which can be manipulated between different configurations; and at least one magnet arranged along an edge of at least certain of the blocks to attract the edge of another block in juxtaposition with it, so that the two juxtaposed blocks are able to be manipulated to rotate about an axis formed along the two juxtaposed edges, a stronger attractive force being exerted at the axis between the two juxtaposed blocks, and a weaker attractive force is exerted along the juxtaposed edges parallel to but remote from the axis, to enable faces of the blocks in contact to be split apart and rotated about the axis until another pair of faces come into contact, such that, in this new position, a stronger attractive force is again exerted at the axis and a weaker attractive force is again exerted remote from the axis, the stronger attractive forces holding the separate blocks together as a unit in all the configurations of the unit, where the unit is arranged so that it can be manipulated between one configuration and another only when two of the axes are brought into alignment, in which case the aligned axes create a "fold line" along which manipulation can occur.

2. A puzzle device according to claim 1, where there are at least two fold lines present in every configuration, so that play can be endless in either forward or reverse directions.

3. A puzzle device according to claim 1, where small bar magnets are positioned in the corners of the blocks with one exposed face having a pole.

4. A puzzle device according to claim 1, where a bar magnet is positioned within the block with a pole in the centre of a face of the block.

5. A puzzle device according to claim 1, where the device is made up of eight small cubes which can be manipulated between two larger cubic configurations and four flat 2×4 configurations.

* * * * *

UNITED STATES PATENT AND TRADEMARK OFFICE

CERTIFICATE OF CORRECTION

PATENT NO. : 6,712,358 B1 
DATED : March 30, 2004
INVENTOR(S) : Spiro Nickolaos Dimitriou and Akrum Afif Geha It is certified that error appears in the above-identified patent and that said Letters Patent is hereby corrected as shown below:

Title page,
Item [30], Foreign Application Priority Data, delete the priority claim.

Signed and Sealed this

Fifteenth Day of November, 2005

JON W. DUDAS
*Director of the United States Patent and Trademark Office*